US007044438B2

(12) United States Patent
Feyerl et al.

(10) Patent No.: US 7,044,438 B2
(45) Date of Patent: May 16, 2006

(54) ELECTROMAGNETIC ACTUATOR WITH NON-SYMMETRICAL MAGNETIC CIRCUIT LAYOUT FOR ACTUATING A GAS-REVERSING VALVE

(75) Inventors: Günter Feyerl, Alsdorf (DE); Hans Kemper, Aachen (DE); Christian Boie, Aachen (DE); Lukas Wagener, Herzogenrath (DE)

(73) Assignee: FEV Motorentechnik GmbH, Aachen (DE)

( * ) Notice: Subject to any disclaimer, the term of this patent is extended or adjusted under 35 U.S.C. 154(b) by 182 days.

(21) Appl. No.: 10/826,698

(22) Filed: Apr. 19, 2004

(65) Prior Publication Data

US 2004/0222398 A1 Nov. 11, 2004

(30) Foreign Application Priority Data

Apr. 17, 2003 (DE) ..... 103 17 644

(51) Int. Cl.
*F16K 31/02* (2006.01)

(52) U.S. Cl. ..... 251/129.1; 335/220; 335/281; 123/90.11

(58) Field of Classification Search ..... 251/129.09, 251/129.1, 129.16; 335/220, 281; 123/90.11
See application file for complete search history.

(56) References Cited

U.S. PATENT DOCUMENTS

| | | | | |
|---|---|---|---|---|
| 6,078,235 | A * | 6/2000 | Schebitz et al. | 335/220 |
| 6,373,361 | B1 * | 4/2002 | Umemoto et al. | 335/220 |
| 6,516,758 | B1 * | 2/2003 | Leiber | 123/90.11 |
| 6,691,651 | B1 * | 2/2004 | Yonekura et al. | 123/90.11 |
| 6,763,789 | B1 * | 7/2004 | Liang et al. | 123/90.11 |

FOREIGN PATENT DOCUMENTS

DE 199 07 850 A1 9/2000

* cited by examiner

*Primary Examiner*—John Bastianelli
(74) *Attorney, Agent, or Firm*—Venable LLP; Robert Kinberg; Catherine M. Voorhees

(57) ABSTRACT

An electromagnetic actuator for actuating a gas-reversing valve on a piston internal combustion engine includes two electromagnets. Each electromagnet includes a one yoke body presenting a pole face. The pole faces of the two electromagnets face each other at a distance. Each yoke body has two parallel grooves that are open toward the pole face and form a coil window with a coil disposed in the coil window. An armature is arranged to move back and forth between the pole faces counter to the force of at least one restoring spring. The two electromagnets each have a different load profile.

7 Claims, 4 Drawing Sheets

ELECTROMAGNETIC ACTUATOR WITH NON-SYMMETRICAL MAGNETIC CIRCUIT LAYOUT FOR ACTUATING A GAS-REVERSING VALVE

CROSS-REFERENCE TO RELATED APPLICATION

This application claims the priority of German Patent Application No. 103 17 644.6, filed on Apr. 17, 2003, the subject matter of which is incorporated herein by reference.

BACKGROUND OF THE INVENTION

An electromagnetic actuator for actuating a gas-reversing valve on a piston internal combustion engine essentially comprises two electromagnets, the pole faces of which are arranged so as to face each other at a distance. Between these two electromagnets, an armature can move back and forth counter to the force of at least one restoring spring, such that with a correspondingly controlled alternating feed of current to the two electromagnets, the gas reversing valve is alternately moved to the closed position or the opened position.

The alternating current feed occurs such that power is turned off to the electromagnet, in this case the closing magnet, which keeps the armature in one end position, for example the closed position of the valve. The armature thus can detach itself from the pole face with the aid of the respectively pre-stressed opening spring and is accelerated in the direction of the other magnet, which in this case is the opening magnet. The opening magnet is then supplied with current, so that the armature is securely captured while it passes through the center position during the approach to the pole face of the opening magnet and is held for the predetermined opening interval against the pole face. In the process, the valve spring that functions as the restoring spring is compressed, so that once the current to the opening magnet is turned off, the movement course is the same as for the closed position. The electromagnets are identical in size and have the same layout with respect to capacity, e.g. as disclosed in German patent document DE 197 14 496 A1. In addition, it has been standard procedure, up to now, to equip all gas-reversing valves of a piston internal combustion engine with identical actuators.

However, it has turned out that a higher electrical capacity is required for opening the gas-exhaust valves than for opening the gas intake valves. This is due to the fact that losses caused by the pressure differences between combustion chamber and exhaust port during the opening of the gas exhaust valve, which act upon the valve in closing direction, must be compensated if the engine load increases. To meet this requirement, it has been suggested according to German patent document DE 199 07 850 A1 that actuators be assigned to the gas exhaust valves, for which the electromagnets have a larger pole face than the electromagnets of the actuators assigned to the gas intake valves. However, the so-called "identical parts principle" for the actuators was maintained for this solution, meaning each actuator comprises identical magnets having identical pole faces.

SUMMARY OF THE INVENTION

It is an object of the present invention to create an actuator which takes into account the different capacity requirements to be met by the gas intake valves as well as the gas exhaust valves.

The above and other objects are accomplished according to one exemplary embodiment of the invention wherein there is provided an electromagnetic actuator for actuating a gas-reversing valve on a piston internal combustion engine, comprising: two electromagnets each including a coil and one yoke body presenting a pole face, the pole faces of the two electromagnets facing each other at a distance, wherein each yoke body has two parallel grooves that are open toward the pole face and form a coil window with the coil disposed in the coil window, and the two electromagnets each have a different load profile; at least one restoring spring; and an armature arranged to move back and forth between the pole faces counter to a force of the at least one restoring spring.

Thus, in accordance with the invention, it is possible to design advantageous electromagnetic actuators for actuating the gas-reversing valves of piston internal combustion engines with changing load requirements, for example for vehicle drives which take into account the limited power supply on board of a vehicle. With respect to its load profile, the opening magnet on an electromagnetic actuator for actuating a gas exhaust valve is therefore designed so that the available limited electrical energy is sufficient to allow the actuator to meet the maximum required capacity. Important in this connection is also the limitation of the current level and/or an optimization of the energy consumption that is predetermined by the available electrical switching elements. With a gas exhaust valve, on the other hand, it is not necessary to feed in the same amount of electrical energy for the closing operation. Thus, according to the invention, the closing magnet on an actuator of this type can be designed for a correspondingly smaller load profile.

As a result of using electromagnetic actuators for actuating the gas-reversing valves, it is possible even with piston internal combustion engines provided with at least two gas intake valves to actuate only one gas intake valve and to keep the other one closed during the partial-load operation. One disadvantage with piston internal combustion engines where fuel is injected into the gas intake port is that fuel also accumulates in the intake port of the closed gas intake valve. To avoid this disadvantage, the gas intake valve, which is kept in the closed state per se, is opened briefly with the aid of a so-called "mini stroke" during the intake phase of the respective cylinder, so that the fuel-air-mixture in the intake port of this gas intake valve is also suctioned into the cylinder and practically no disadvantageous fuel deposits can form on the valve. To realize this "mini stroke," it is necessary to immediately restart the current feeding to the closing magnet after turning it off, wherein a strong magnetic force must act upon the armature to overcome the force of the opening spring which is high at that instant and to force the armature to make contact once more with the pole face, where it is kept by the normally low and furthermore clocked holding current. The inventive solution furthermore has considerable advantages for this application since the closing magnet of the actuator must be designed for a correspondingly high load profile for actuating the gas intake valve while the opening magnet must be designed for a correspondingly lower load profile. The above-explained limitation with respect to the available electrical energy and/or an optimized energy consumption applies in this case as well.

The present invention takes another step away from the so-called "identical parts principle," meaning the use of identical designs for the actuators on the gas intake side and the gas exhaust side, by using different electromagnet designs on an actuator, corresponding to the requirements for the opening and closing operation.

One inventive embodiment provides that the different load profiles are realized by using different dimensions for the pole faces of the two electromagnets. In the process, the ratio of width to length can be varied when dimensioning the pole faces of the yoke bodies, so that preset values for the available structural space can be taken into account as well.

According to a different embodiment, the different load profiles are realized by having different "coil window" geometries for the two electromagnets. For example, if the pole face of the electromagnet with the higher load profile cannot be increased because of the existing structural space, the requirements for a higher load profile can be met by changing the so-called "coil window," for example by changing the depth and/or the width of the grooves. A change in the groove width simultaneously results in a change of the pole face, so that a corresponding reduction in the pole face can be achieved by increasing the groove width on the electromagnet with the lower load profile while the groove depth remains the same.

According to a different embodiment of the invention, the requirements for a different load profile are met by having coils with a different number of windings and/or a different conductor cross-section.

Combining the dimensioning of the "coil window" geometry and the layout of the coils with respect to winding number and conductor cross section, makes it possible to design an actuator with two electromagnets having different load profiles, which essentially show the same type of electrical behavior, especially for the power consumption. Thus, despite these differences, the so-called "electro-dynamic" characteristics of both electromagnets are the same and/or are individually adapted which is particularly advantageous for the feeding of current to the electromagnets.

BRIEF DESCRIPTION OF THE DRAWINGS

The invention is explained in further detail with the aid of schematic drawings of exemplary embodiments.

DETAILED DESCRIPTION OF THE INVENTION

Figure 1:
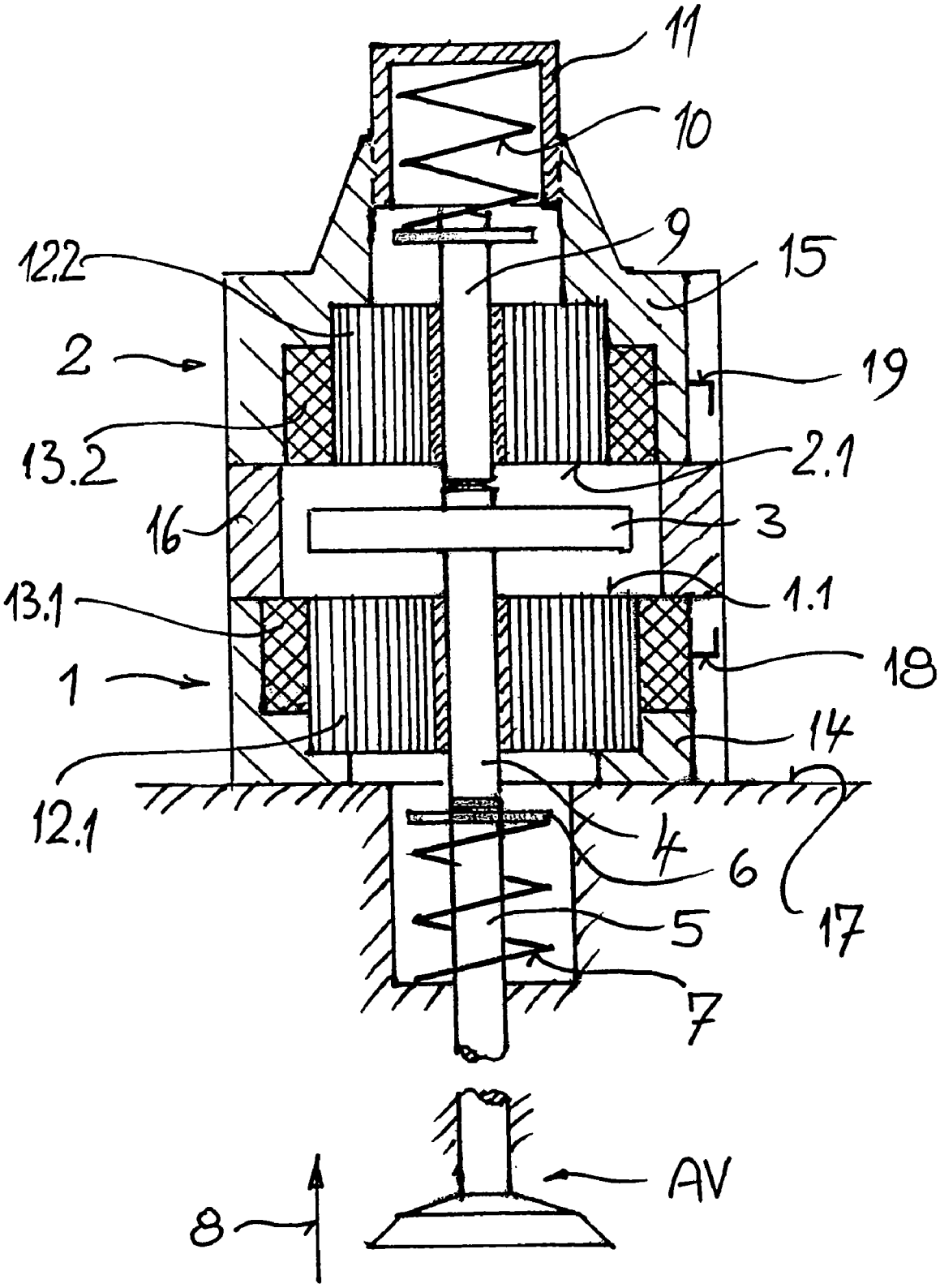
FIG. 1 is a sectional view of an electromagnetic actuator for actuating a gas exhaust valve.

Referring to FIG. 1, there is shown a schematic sectional view of an electromagnetic actuator for actuating a gas exhaust valve AV according to an exemplary embodiment of the invention. The electromagnetic actuator of FIG. 1 essentially comprises an opening magnet 1 and a closing magnet 2 having respective pole faces 1.1 and 2.1 arranged facing each other at a distance. An armature 3 is movable back and forth between two pole faces 1.1 and 2.1 with the aid of an armature bolt 4. Armature bolt 4 supports itself on a stem 5 for gas exhaust valve AV, which is provided with a spring plate 6 for supporting a valve spring 7 that functions as a closing spring and acts upon the gas exhaust valve AV in a closing direction as denoted by arrow 8.

On the other side, armature 3 supports itself via a spring bolt 9 on an opening spring 10, the force effect of which is counter to the force effect of closing spring 7. The springs 7 and 10 are pre-stressed so that armature 3 is in a rest position between the two pole faces 1.1 and 2.1, wherein this generally is a center position. The rest position of armature 3 can be adjusted via an adjustment element 11, for example a screw cap, that is assigned to opening spring 10.

Opening magnet 1 is provided with a tin-plated yoke body 12.1 with a coil 13.1, while closing magnet 2 has a yoke body 12.2 with a coil 13.2.

As indicated in the drawings, two yoke bodies 12.1 and 12.2 are designed as so-called "tin-plated" yoke bodies, meaning they are composed of a plurality of thin metal sheets of an electromagnetically soft material. However, the yoke bodies can also be produced from a different type of material, for example a corresponding "soft-magnetic" sintered material that is composed to prevent, for the most part, the forming of eddy currents during the respective magnetic reversal.

The two yoke bodies and their coils are each secured inside a respective housing part 14, 15 that consists of a non-magnetizable material, e.g. aluminum. The two housing parts 14 and 15 are fixedly connected via a spacing frame 16, disposed in-between, which encloses the movement space for armature 3. The actuator, configured in this way, is on the whole fixedly connected to a cylinder head 17 of the piston internal combustion engine that is only indicated herein.

The two housing parts 14 and 15 are provided with openings on one side through which the connecting elements 18 and/or 19 extend, such that the coils 13 can be connected to a controllable power supply.

Figure 2:
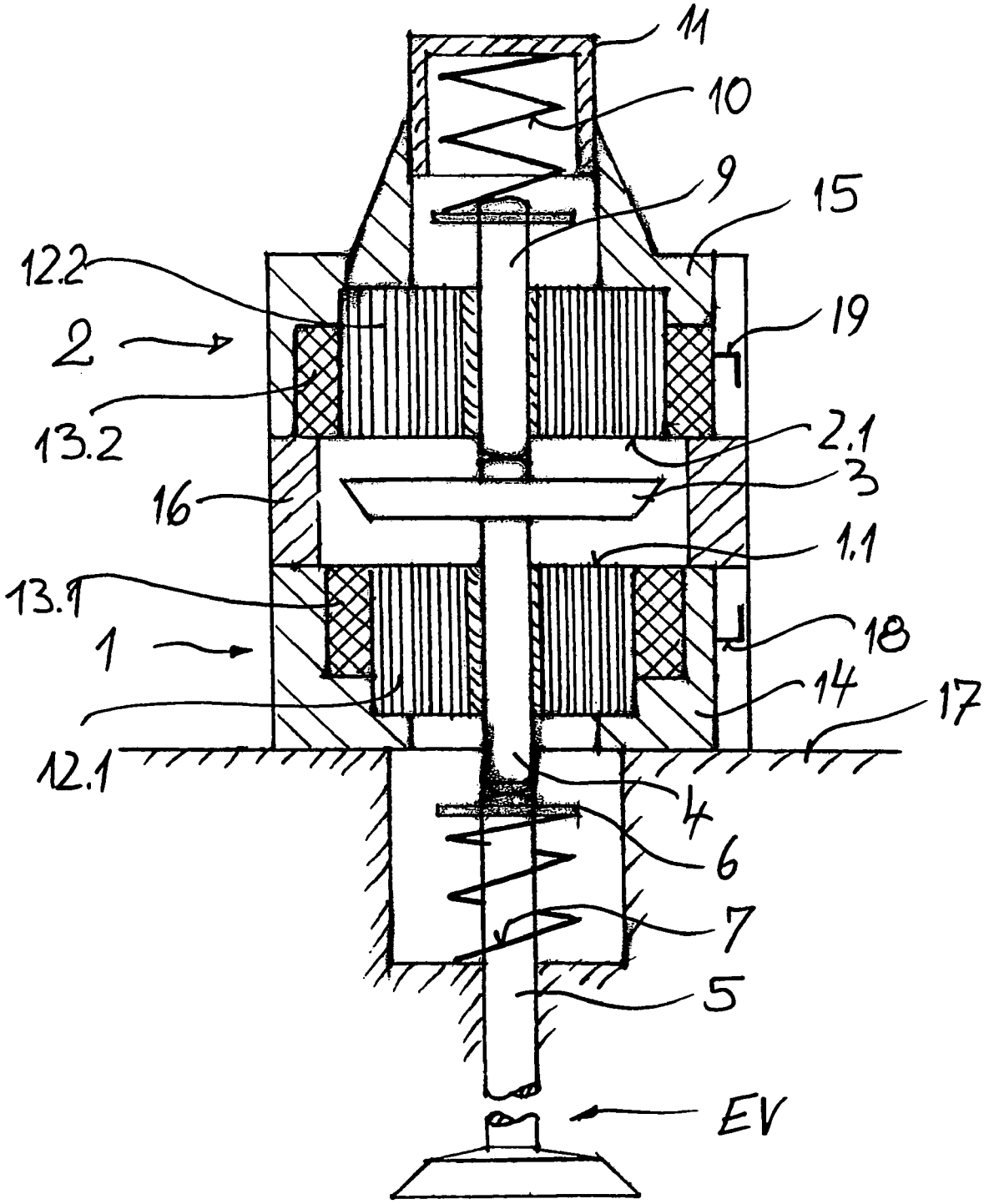
FIG. 2 is a sectional view of an electromagnetic actuator for actuating a gas intake valve.

The actuator for actuating a gas intake valve EV, shown in FIG. 2, is configured in the same way, so that identical components are provided with the same reference numbers. However, there are differences between the two embodiments. Opening magnet 1 for the gas exhaust valve AV shown in FIG. 1 is designed for a larger load profile as compared to closing magnet 2. In particular, yoke body 12.1 of opening magnet 1 is shown to be larger than yoke body 12.2 of opening magnet 2.

On the other hand, for the actuator embodiment shown in FIG. 2 for actuating a gas intake valve EV, closing magnet 2 is designed for a larger load profile than opening magnet 1. This is shown with a correspondingly larger representation of the yoke body 12.2 of closing magnet 2, as compared to the yoke body 12.1 of the opening magnet 1.

Within the framework of designing different load profiles for the two electromagnets, it is furthermore possible to respectively adapt the surfaces of armature 3 that face the pole faces to the dimensions of these pole faces. This is shown in FIG. 2 where the armature surface facing the larger pole face 2.1 is larger than the armature surface facing the smaller pole face 1.1. This can be achieved by beveling the side edges of the armature, as shown in FIG. 2.

According to the embodiment in FIG. 1, a higher magnetic force can thus be provided for the opening operation while maintaining the same current fed to both magnets. In order to open the gas exhaust valve, the current is initially turned off at closing magnet 2, so that opening spring 10 moves armature 3 in the opening direction. Since opening magnet 1 has a higher distance effect due to its configuration for a higher load profile, a magnetic force effect can be exerted onto armature 3 in addition to the restoring force of opening spring 10 if the power is supplied early enough, so that the gas forces developing during the opening operation can be overcome faster and a faster and more complete opening of the flow cross section can be achieved.

With the embodiment shown in FIG. 2 for actuating a gas intake valve, the closing magnet 2 is designed out for a correspondingly higher load profile. As a result, a closed gas intake valve can be opened up briefly with a so-called "mini stroke." For this, power is supplied once more to closing magnet 2, following the shutdown of the power supply for closing magnet 2, and the separation of armature 3 from the pole face 2.1 which is detected, for example, with a distance sensor. Thus, following only a slight detaching from pole face 2.1, armature 3 is returned to this pole face and/or is kept at a defined distance thereto and the associated gas intake valve is closed again after this slight opening stroke. The particular advantage in this case is again that the high spring force of opening spring 10 in the closed position can be overcome with a correspondingly high magnetic force, without requiring that the electrical energy, limited by the maximum and/or user-dependent current level, must be exceeded.

Figure 3:
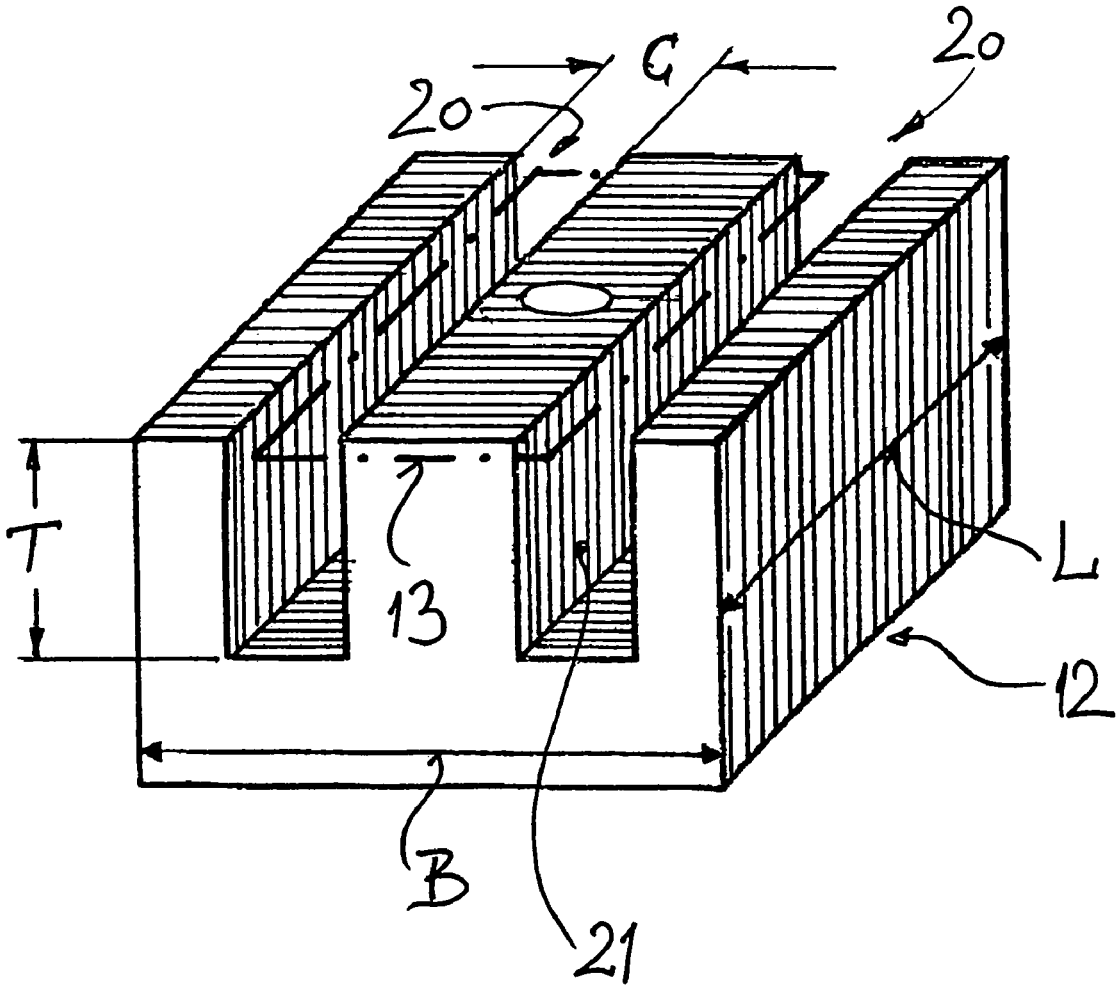
FIG. 3 is a perspective representation of a yoke body for an electromagnet.

FIG. 3 schematically shows a "tin-plated" yoke body 12, meaning a body having the same orientation as used for opening magnet 1 where the pole face 1.1 is pointing in an upward direction. FIG. 3 shows that yoke body 12 is provided with two parallel grooves 20 into which a coil 13 is inserted, as shown schematically herein with a dash-dot line. Grooves 20 are aligned crosswise to the orientation of the individual sheets that form yoke body 12.

Yoke body 12 is essentially defined through its length L in the longitudinal direction of grooves 20 and its width B crosswise to the extension of grooves 20.

The dimensions for grooves 20 are determined by their depth T and their width C, wherein the cross section of a groove 20 that is limited by width C and depth T at the same time predetermines the dimensions for a so-called "coil window" 21.

The size of a pole face 1.1 and/or 2.1 for a predetermined "coil window" 21 can essentially be determined by correspondingly determining the ratio of length L to width B. On the other hand, the pole face having a predetermined ratio L/B can be changed by correspondingly changing the dimensions for depth T and width C of grooves 20.

The dimensions of the "coil window" 21 simultaneously influence the size of the coil. Thus, the pole face can be varied again by changing the depth T and the width C with predetermined dimensions L and B while maintaining the same conductor cross section and the same number of windings for a coil.

A different variation is possible in connection with corresponding changes in the dimensions of grooves 20 by changing the winding number and/or the total conductor cross section. Dimensioning the coil with respect to winding number and total conductor cross section furthermore makes it possible to optimize the electro-dynamic behavior with respect to the alternating current feed.

By abandoning the generally used "identical parts principle" for electromagnetic actuators of this type and taking into consideration its use with a "gas exhaust valve," as well as a "gas intake valve," it is possible to create actuators where the two electromagnets respectively are no longer identical and where the electromagnets are configured for a predetermined load profile. Critical for the determination is always the magnet with the respectively largest load profile, meaning the opening magnet for gas exhaust valves and the closing magnet for gas intake valves. The respectively associated other magnet can also be configured for a smaller load profile by taking into consideration the load to be used for the predetermined application case.

Actuators configured according to the "identical parts principle" so far have always been configured for the larger load profile. Thus, the solution according to the invention provides the option of having a smaller design for the electromagnets which respectively must provide a smaller load during the operation, thus reducing the actuator weight on the whole as well as the consumed electrical power.

A further advantage is that the maximum required current level can be limited via the dimensioning of the "coil window" 21 and/or via the dimensioning of the coil 13 with respect to winding number and total conductor cross section, thus making it possible to optimally adapt the available and/or permissible capacity of the power supply, but also the switching capacity of the existing switching elements.

A noticeably smaller load profile is required for capturing the armature 3 for the gas exhaust valve in its closed position and for the gas intake valve in its opened position, so that smaller electromagnets can be used for the closing magnets on the actuators of gas exhaust valves and for the opening magnets on the actuators of the gas intake valves with respect to their load profiles.

Figure 4:
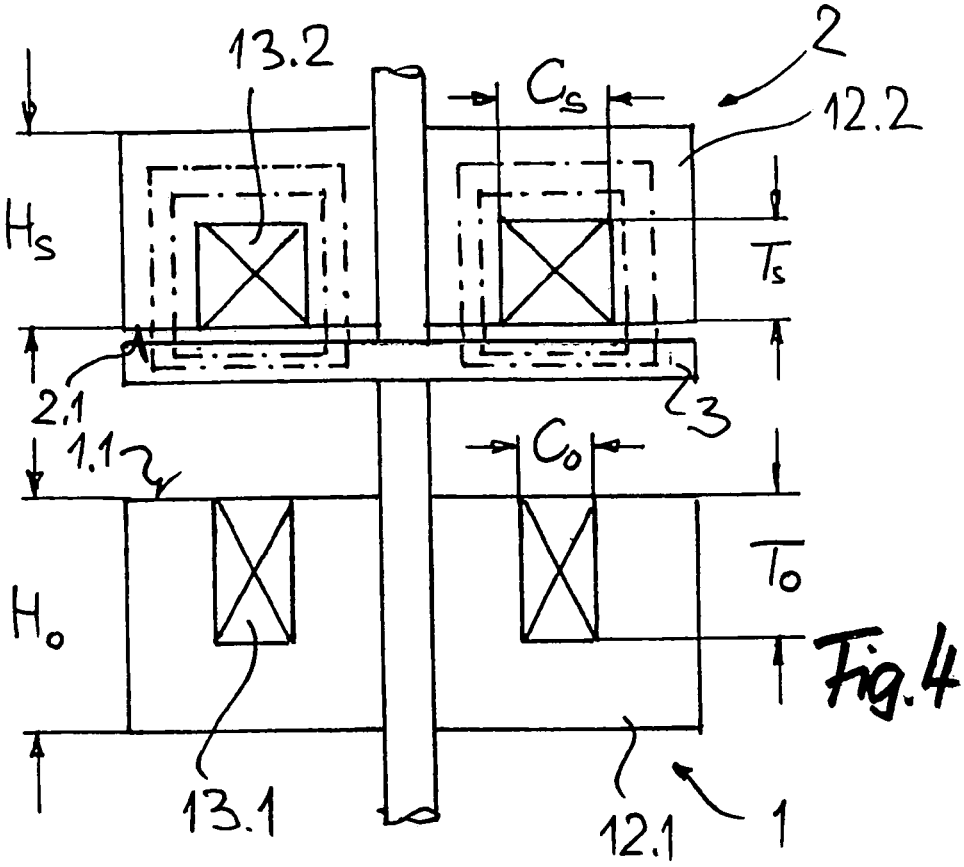
FIG. 4 is an actuator for a gas exhaust valve once it reaches the closed position.
Figure 5:
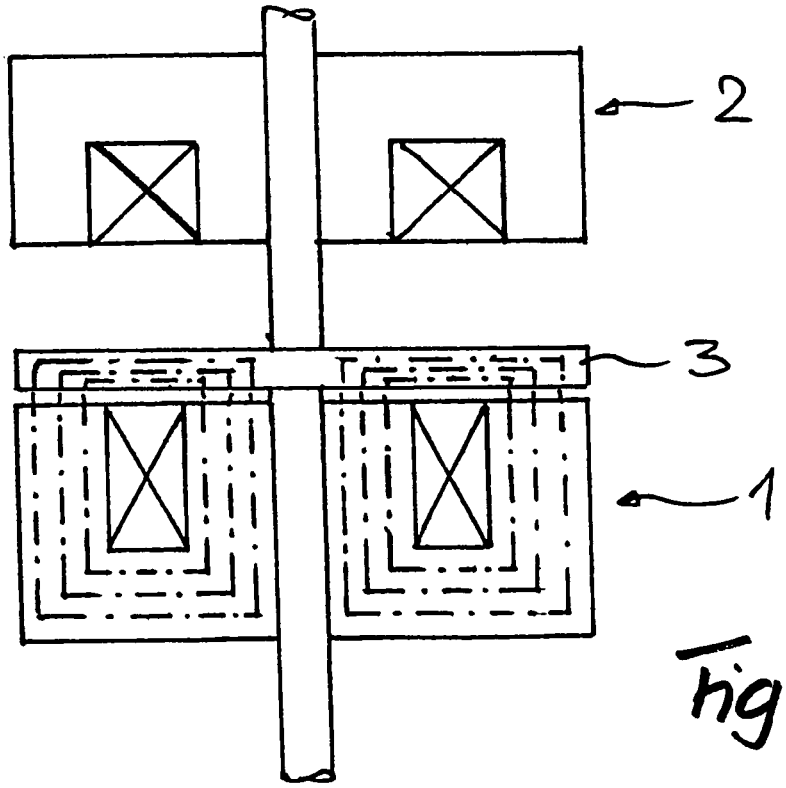
FIG. 5 is an actuator according to FIG. 4 once it reaches the opened position.

FIGS. 4 and 5 show an actuator used to actuate a gas exhaust valve, in a view that corresponds to the viewing direction in FIG. 3. FIG. 4 in this case shows the actuator shortly before the armature 3 comes to rest against the closing magnet 2. FIG. 5 shows the actuator shortly before the armature 3 comes to rest against the opening magnet 1.

With this exemplary embodiment, the cross-sectional surface of the coil window 21 and/or the coils 13 is the same for both electromagnets. The difference, however, can be found in the dimensions T and C.

With the same dimensions B and L (FIG. 3) for both yoke bodies 12.1 and 12.2 and having the same number of windings and the same conductor cross sections for both coils 13.1 and 13.2, this measure alone results in a clear change in the respectively effective pole face. In this case, the pole face 1.1 is larger than the pole face 2.1. Accordingly, the load profile that can be met for the closing magnet 2 is smaller than for the opening magnet 1, as shown in a comparison to FIG. 5. The differences in the load profile that can be met are indicated schematically by the differences in the number and density of the "magnetic lines."

The electromagnets of an actuator for a gas intake valve must correspondingly be arranged differently, meaning the closing magnet 2 is designed for a larger load profile than the opening magnet 1. Thus, it is possible to maintain the armature 3 in a suspended position at a short distance to the pole face 2.1 since a higher magnetic energy is available.

If, for the same dimensions for B and L, $C_s$ is increased as compared to $C_o$ and $T_s$ is reduced relative to $T_o$, with an identical cross-sectional surface of the coil window, then the height $H_s$ of the yoke body 12.2 can also be reduced relative to the height $H_o$ of yoke body 12.1. This results in an overall reduction of the structural height by $H_o - H_s = \Delta H$.

This schematic example shows that the dimensions B and L for the yoke bodies and/or the winding number and/or the conductor cross section of the coils can be changed respectively to conform to the layout of the load profile. Thus, in addition to representing a preset load profile, it is also possible to optimize the "packaging" with respect to the structural space.

The above description of the configuration and adaptation options also shows that starting with a maximum possible and/or maximum reliable load profile, it is possible to influence the outer dimensions of an actuator of this type so that even existing restrictions in the structural height can be considered. For this, the actuators of an internal combustion engine can again be dimensioned differently on the gas intake side than on the gas exhaust side with respect to the load profiles of the electromagnets.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An electromagnetic actuator for actuating a gas-reversing valve on a piston internal combustion engine, comprising:

two electromagnets each including a coil and one yoke body presenting a pole face, the pole faces of the two electromagnets facing each other at a distance, wherein each yoke body has two parallel grooves that are open toward the pole face and form a coil window with the coil disposed in the coil window and the two electromagnets each have a different load profile;

at least one restoring spring; and an armature arranged to move back and forth between the pole faces counter to a force of the at least one restoring spring.

2. The actuator according to claim 1, wherein the yoke bodies of the respective electromagnets have differently sized pole faces.

3. The actuator according to claim 1, wherein the yoke bodies or the respective electromagnets have coil windows with different dimensions.

4. The actuator according to claim 1, wherein the electromagnets have coil bodies with at least one of different winding numbers and different conductor cross sections.

5. The actuator according to claim 1, wherein the valve is a gas intake valve, one of the electromagnets is a closing magnet and the other of the electromagnets is an opening magnet, and wherein the closing magnet has a higher load profile than the opening magnet.

6. The actuator according to claim 1, wherein the valve is a gas exhaust valve, one of the electromagnets is an opening magnet and the other of the electromagnets is a closing magnet, and wherein the opening magnet has a higher load profile than the closing magnet.

7. The actuator according to claim 1, wherein the armature has opposite surfaces each facing a respective one of the facing pole faces and each armature surface has approximately the same size or dimensions as the respective pole face.

* * * * *